US009157045B2

(12) United States Patent
Fagan

(10) Patent No.: US 9,157,045 B2
(45) Date of Patent: Oct. 13, 2015

(54) CONTINUOUS LITHIUM COMPLEX GREASE MANUFACTURING PROCESS WITH A BORATED ADDITIVE

(71) Applicant: Gian Lawrence Fagan, Fairfield, CA (US)

(72) Inventor: Gian Lawrence Fagan, Fairfield, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 38 days.

(21) Appl. No.: 14/091,814

(22) Filed: Nov. 27, 2013

(65) Prior Publication Data

US 2015/0148274 A1 May 28, 2015

(51) Int. Cl.

| | |
|---|---|
| ***C10M 163/00*** | (2006.01) |
| ***C10M 169/02*** | (2006.01) |
| ***C10M 115/04*** | (2006.01) |
| ***C10M 117/04*** | (2006.01) |
| ***C10M 169/06*** | (2006.01) |
| ***C10M 177/00*** | (2006.01) |

(52) U.S. Cl.

CPC ..... *C10M 117/04* (2013.01); *C10M 169/06* (2013.01); *C10M 177/00* (2013.01); *C10M 2203/1006* (2013.01); *C10M 2203/1025* (2013.01); *C10M 2203/1085* (2013.01); *C10M 2205/0285* (2013.01); *C10M 2207/1276* (2013.01); *C10M 2207/1285* (2013.01); *C10M 2227/061* (2013.01); *C10N 2210/01* (2013.01)

(58) Field of Classification Search

CPC ..... C10M 2203/1025; C10M 2220/022; C10M 117/04; C10M 169/06; C10M 177/00; C10M 2203/1085; C10M 2203/1006; C10M 2207/1276; C10M 2205/0285; C10M 2227/061; C10M 2207/1285; C10N 2210/01

USPC ..... 508/150, 189, 519

See application file for complete search history.

(56) References Cited

U.S. PATENT DOCUMENTS

| | | | | |
|---|---|---|---|---|
| 3,475,335 | A | | 10/1969 | Greene et al. |
| 3,758,407 | A | * | 9/1973 | Harting ..... 508/158 |
| 3,907,691 | A | | 9/1975 | King et al. |
| 4,155,858 | A | | 5/1979 | Adams |
| 4,297,227 | A | | 10/1981 | Witte et al. |

(Continued)

FOREIGN PATENT DOCUMENTS

| | | |
|---|---|---|
| GB | 2215346 | 9/1989 |

OTHER PUBLICATIONS

Amott, Earl, and McLennan, L W., "Complexes in Lubricating Oil Greases", The Institute Spokesman, Mar. 1951, pp. 7-21.

(Continued)

*Primary Examiner* — Pamela H Weiss

(74) *Attorney, Agent, or Firm* — Melissa M. Hayworth; Steven H. Roth; Susan M. Abernathy

(57) ABSTRACT

A continuous process with increased production throughput of a high dropping point lithium complex grease composition comprising the steps of heating a mixture of a $C_{12}$ to $C_{24}$ hydroxy fatty acid or a $C_{12}$ to $C_{24}$ hydroxy fatty acid ester, an aqueous solution of lithium base and at least one base oil at an elevated temperature; removal of volatiles (i.e., water and methanol, etc.) in a dehydration zone; and transferring the mixture to a recycle line wherein additives, a borated additive and at least one base oil are added to afford a formulated grease composition.

25 Claims, 1 Drawing Sheet

(56) References Cited

U.S. PATENT DOCUMENTS

| | | | | | |
|---|---|---|---|---|---|
| 4,392,967 | A | * | 7/1983 | Alexander | 508/454 |
| 4,444,669 | A | | 4/1984 | Wittse et al. | |
| 4,582,617 | A | * | 4/1986 | Doner et al. | 508/185 |
| 4,600,517 | A | * | 7/1986 | Doner et al. | 508/185 |
| 4,743,386 | A | | 5/1988 | Doner et al. | |
| 4,780,227 | A | | 10/1988 | Doner et al. | |
| 4,781,850 | A | | 11/1988 | Doner et al. | |
| 4,802,999 | A | | 2/1989 | Koizumi et al. | |
| 4,828,732 | A | | 5/1989 | Doner et al. | |
| 4,828,734 | A | | 5/1989 | Doner et al. | |
| 4,879,054 | A | * | 11/1989 | Waynick | 508/174 |
| 5,068,045 | A | | 11/1991 | Doner et al. | |
| 5,242,045 | A | | 9/1993 | Kakida et al. | |
| 5,242,610 | A | | 9/1993 | Doner et al. | |
| 5,252,237 | A | | 10/1993 | Andress | |
| 5,476,600 | A | * | 12/1995 | Witte | 508/539 |
| 2008/0108529 | A1 | * | 5/2008 | Hobson et al. | 508/164 |
| 2012/0322707 | A1 | * | 12/2012 | Bredsguard et al. | 508/465 |
| 2013/0157907 | A1 | | 6/2013 | Brossaud | |

OTHER PUBLICATIONS

International Search Report from corresponding PCT Application No. PCT/US2014/067653, mailed on Feb. 25, 2015.

* cited by examiner

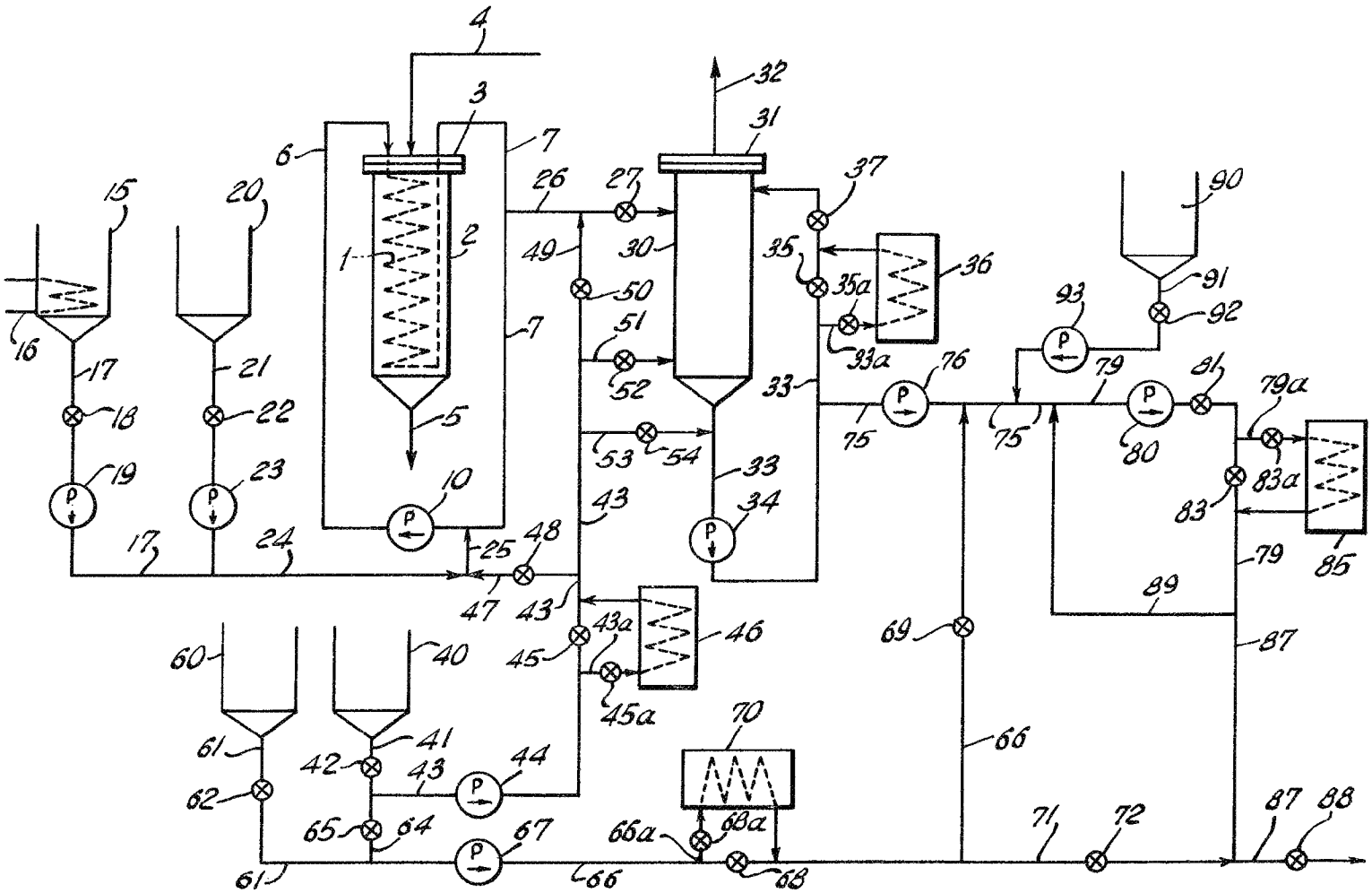

CONTINUOUS LITHIUM COMPLEX GREASE MANUFACTURING PROCESS WITH A BORATED ADDITIVE

FIELD OF THE INVENTION

The invention encompasses a continuous process for the manufacture of a high dropping point lithium complex grease without the use of a dicarboxylic fatty acid or dicarboxylic fatty acid ester as part of the thickener for the grease. The conventional use of a dicarboxylic fatty acid or dicarboxylic fatty acid ester as part of the thickener is substituted herein with a borated additive, which is fed into the reactor downstream of the thickener formation zone.

BACKGROUND OF THE INVENTION

Lithium soaps are the most common thickeners used in the formulation of lubricating greases. Lithium soaps used for grease making are classified into two types: simple soap and complex soap. The main performance difference between the two is the greater thermal stability of the lithium complex greases as seen in the dropping point (ASTM D566 or D2265). Both types contain the lithium salt of a fatty acid. Lithium complex soaps contain an additional lithium salt, or "complexing agent", most commonly a dilithium salt of a low molecular weight dibasic organic acid or dibasic ester.

Lithium greases can be manufactured by continuous process in a heated tube reactor (U.S. Pat. Nos. 4,297,227; 3,475,335; and 4,444,669). The process is most convenient and problem-free for simple lithium soap thickened greases. However, lithium complex greases having much higher thickener concentrations resulted in increased difficulties during continuous production. These difficulties include wide fluctuations in flow rates, cessation of flow and resultant downtime, and greatly reduced unit production capacity.

SUMMARY OF THE INVENTION

The invention herein relates to a continuous process for production of high dropping point lithium complex greases by elimination of the conventional dibasic acid salt or dibasic ester component. These conventional components are substituted with a borated additive fed into the reactor downstream of the thickener formation zone. This substitution and process modification results in a significantly less problematic process and a substantial increase in production throughput.

Therefore, it would be desirable to prepare a high dropping point lithium complex grease composition in a continuous process that is free of the inherent production difficulties when using dibasic acid salt or dibasic ester components.

A continuous process for the manufacture of high dropping point lithium complex grease compositions comprising the steps of heating a mixture of a $C_{12}$ to $C_{24}$ hydroxy fatty acid or a $C_{12}$ to $C_{24}$ hydroxy fatty acid ester, an aqueous solution of lithium base and a at least one base oil into a reaction zone at an elevated temperature; removal of volatiles (i.e., water and methanol, etc.) in a dehydration zone; and transferring the mixture to a recycle line wherein additives, a borated additive and at least one base oil are added to afford a formulated grease composition.

DETAILED DESCRIPTION OF THE INVENTION

In some embodiments, the present invention provides a continuous process for preparing a lithium complex grease, comprising: (a) heating a mixture of a $C_{12}$ to $C_{24}$ hydroxy fatty acid or a $C_{12}$ to $C_{24}$ hydroxy fatty acid ester, an aqueous solution of lithium base and at least one base oil in a reaction zone at a temperature between about 120° C. to about 200° C. under turbulent mixing conditions; (b) passing the mixture of Step (a) through a heat exchanger that raises the temperature of the mixture to between about 150° C. to about 200° C.; (c) transferring the mixture of Step (b) to a dehydration zone which is maintained at temperature between about 125° C. to about 225° C.; and (d) transferring the mixture of Step (c) to a recycle line whereby additives, a borated additive and at least one base oil are added under turbulent mixing conditions to afford a formulated grease composition, wherein the continuous process does not include a dibasic acid or dibasic ester component and wherein the formulated grease composition has a dropping point greater than about 240° C. according to ASTM D2265.

In some embodiments, the present invention provides a continuous process for preparing a lithium complex grease, wherein the hydroxy fatty acid is 12-hydroxy stearic acid.

In some embodiments, the present invention provides a continuous process for preparing a lithium complex grease, wherein the hydroxy fatty acid ester is the methyl or ethyl ester of 12-hydroxy stearic acid.

In some embodiments, the present invention provides a continuous process for preparing a lithium complex grease, wherein the temperature of Step (a) is between about 160° C. to about 190° C. and the pressure is between about 95 psig to about 170 psig.

In some embodiments, the present invention provides a continuous process for preparing a lithium complex grease, wherein the temperature of Step (a) is between about 170° C. to about 185° C.

In some embodiments, the present invention provides a continuous process for preparing a lithium complex grease, wherein the temperature of Step (a) is between about 176° C. to about 177° C.

In some embodiments, the present invention provides a continuous process for preparing a lithium complex grease, wherein the pressure in the reaction zone is between about 140 psig to about 160 psig.

In some embodiments, the present invention provides a continuous process for preparing a lithium complex grease, wherein the pressure in the reaction zone is between about 149 psig to about 151 psig.

In some embodiments, the present invention provides a continuous process for preparing a lithium complex grease, wherein the lithium base is selected from the group consisting of lithium oxide, lithium hydroxide, lithium hydroxide monohydrate and lithium carbonate.

In some embodiments, the present invention provides a continuous process for preparing a lithium complex grease, wherein the lithium base is lithium hydroxide.

In some embodiments, the present invention provides a continuous process for preparing a lithium complex grease, wherein the base oil is a bright stock base oil, Group I base oil, Group II base oil, Group II+ base oil, Group III base oil, Group IV base oil, 150R, 600R, 110RLV, 220R, 100R or combinations thereof.

In some embodiments, the present invention provides a continuous process for preparing a lithium complex grease, wherein the bright stock base oil has a viscosity of between about 28 cSt at 100° C. to about 37 cSt at 100° C. and a viscosity index of about 95.

In some embodiments, the present invention provides a continuous process for preparing a lithium complex grease, wherein the bright stock base oil has a viscosity of 31 cSt at 100° C.

In some embodiments, the present invention provides a continuous process for preparing a lithium complex grease, wherein the Group II base oil has a viscosity of 110 cSt at 40° C.

In some embodiments, the present invention provides a continuous process for preparing a lithium complex grease, wherein the base oil is a combination of a bright stock base oil with a viscosity of 31 cSt at 100° C. and a Group II base oil with a viscosity of 110 cSt at 40° C.

In some embodiments, the present invention provides a continuous process for preparing a lithium complex grease, wherein the base oil is a combination of a 150 bright stock base oil and 600R.

In some embodiments, the present invention provides a continuous process for preparing a lithium complex grease, wherein the aqueous solution of lithium base of Step (a) is between about 16 wt % to about 20 wt % aqueous lithium hydroxide.

In some embodiments, the present invention provides a continuous process for preparing a lithium complex grease, wherein the aqueous solution of lithium base of Step (a) is about 18 wt % aqueous lithium hydroxide.

In some embodiments, the present invention provides a continuous process for preparing a lithium complex grease, wherein the aqueous solution of lithium base is approximately a 18 wt % lithium hydroxide solution and is added in the required stoichiometric amount plus a 0.05 wt % to 0.2 wt % excess along with a quantity of base oil sufficient to give total theoretical soap concentration of from about 10 weight percent up to about 40 weight percent.

In some embodiments, the present invention provides a continuous process for preparing a lithium complex grease, wherein the lithium hydroxide solution is added in the required stoichiometric amount plus 0.1 wt % excess.

In some embodiments, the present invention provides a continuous process for preparing a lithium complex grease, wherein Step (a) further comprises a turbulent mixing that is maintained in the reaction zone by recirculating the product in the reaction zone.

In some embodiments, the present invention provides a continuous process for preparing a lithium complex grease, wherein the mixture in the reaction zone is recirculated at a recirculation rate ratio of at least about 4:1.

In some embodiments, the present invention provides a continuous process for preparing a lithium complex grease, wherein the heat exchanger of Step (b) raises temperature of the mixture between about 170° C. to about 190° C. at a pressure between about 10 psig to about 40 psig.

In some embodiments, the present invention provides a continuous process for preparing a lithium complex grease, wherein the mixture of Step (b) further comprises a step of shearing the mixture through a shear valve having a pressure difference across the shear valve is between about 30 to about 120 psig.

In some embodiments, the present invention provides a continuous process for preparing a lithium complex grease, wherein the heat exchanger raises temperature of the mixture to about 180° C.

In some embodiments, the present invention provides a continuous process for preparing a lithium complex grease, wherein the dehydration zone temperature of Step (c) is between about 160° C. to about 200° C. and the pressure is between about 10 psig to about 20 psig.

In some embodiments, the present invention provides a continuous process for preparing a lithium complex grease, wherein the dehydration zone temperature of Step (c) is between about 181° C. to about 183° C. and the pressure is about 15.7 psig.

In some embodiments, the present invention provides a continuous process for preparing a lithium complex grease, wherein the Step (c) further comprises a step of shearing the mixture through a shear valve having a pressure difference across the shear valve between about 70 to about 90 psig.

In some embodiments, the present invention provides a continuous process for preparing a lithium complex grease, wherein the Step (c) further comprises a step of shearing the mixture through a shear valve having a pressure difference across the shear valve between is about 80 psig.

In some embodiments, the present invention provides a continuous process for preparing a lithium complex grease, wherein Step (c) further comprises dehydration of the mixture that is partially accomplished by reduction of pressure on the mixture between the reaction zone and the dehydration zone.

In some embodiments, the present invention provides a continuous process for preparing a lithium complex grease, wherein Step (c) further comprises a recirculation rate in the dehydration zone such that a recirculation rate ratio of at least 10:1 is maintained.

In some embodiments, the present invention provides a continuous process for preparing a lithium complex grease, wherein the recirculation rate in the dehydration zone is such that the volume of recycled mixture during the residence time of said mixture within said dehydration zone equals at least 5 to 40 times the total average volume of said mixture within said dehydration zone.

In some embodiments, the present invention provides a continuous process for preparing a lithium complex grease, wherein the recirculation rate in the dehydration zone is such that the volume of recycled mixture during the residence time of said mixture within said dehydration zone equals at least 5 to 30 times the total average volume of said mixture within said dehydration zone.

In some embodiments, the present invention provides a continuous process for preparing a lithium complex grease, wherein Step (c) further comprises a pressure between about atmospheric to about 10 inches of mercury vacuum and mixing the mixture from the bottom to the top of the dehydration zone through a recycle line and a shear valve having pressure drop across the shear valve between about 70 to about 90 psig.

In some embodiments, the present invention provides a continuous process for preparing a lithium complex grease, wherein the additives of Step (d) comprise one or more of an antioxidant, a tackiness agent, a viscosity modifier, a non-ionic surfactant, a corrosion inhibitor, a rust inhibitor, a wear inhibitor, an extreme pressure agent and a polymeric compound.

In some embodiments, the present invention provides a continuous process for preparing a lithium complex grease, wherein the additives of Step (d) are added as separate mixtures comprising:

a. 33.3 wt % viscosity modifier, 16.7 wt % borated additive, 50 wt % of a base oil mixture consisting of 90 wt % of a Group II base oil of viscosity of 110 cSt at 40° C. and 10 wt % of a bright stock of viscosity of 31 cSt at 100° C.;
b. 37.5 wt % tackiness agent, 25 wt % extreme pressure agent, 50 wt % of a base oil mixture consisting of 90 wt % of a Group II base oil of viscosity of 110 cSt at 40° C. and 10 wt % of a bright stock of viscosity of 31 cSt at 100° C.; and
c. 33.3 wt % rust inhibitor, 66.7 wt % of a base oil mixture consisting of 90 wt % of a Group II base oil of viscosity of 110 cSt at 40° C. and 10 wt % of a bright stock of viscosity of 31 cSt at 100° C.

In some embodiments, the present invention provides a continuous process for preparing a lithium complex grease, wherein Step (d) further comprises cooling the mixture from the dehydration zone by adding an amount of base oil.

In some embodiments, the present invention provides a continuous process for preparing a lithium complex grease, wherein the process further comprises recycling the formulated grease composition formed in Step (d) through a cooler set to a temperature between about 80° C. to about 105° C. and a shear valve.

In some embodiments, the present invention provides a continuous process for preparing a lithium complex grease, wherein the process further comprises recycling the formulated grease composition formed in Step (d) through a cooler set to a temperature of about 93° C. and a shear valve.

In some embodiments, the present invention provides a continuous process for preparing a lithium complex grease, wherein Step (d) further comprises as the grease mixture cools it is recycled through a shearing valve at a rate such as to maintain a minimum recycle ratio of 4.5 to 1.

In some embodiments, the present invention provides a continuous process for preparing a lithium complex grease, wherein the amount of base oil added to the mixture at a rate necessary to give the desired consistency to the formulated grease composition.

In some embodiments, the present invention provides a continuous process for preparing a lithium complex grease, wherein Step (d) further comprises a temperature of the formulated grease composition is low enough for safe handling and packaging and high enough to permit pumping of the product without excessive pressure drop over the length of the pumping line.

In some embodiments, the present invention provides a continuous process for preparing a lithium complex grease, wherein the formulated grease composition temperature is between about 80° C. to about 121° C.

In some embodiments, the present invention provides a continuous process for preparing a lithium complex grease, wherein the formulated grease composition has a dropping point greater than about 250° C., greater than about 260° C. or greater than about 270° C. according to ASTM D2265.

In some embodiments, the present invention provides a continuous process for preparing a lithium complex grease, wherein the formulated grease composition has a dropping point of between about 258° C. to about 269° C. according to ASTM D2265.

In some embodiments, the present invention provides a continuous process for preparing a lithium complex grease, wherein the formulated grease composition has a worked penetration between 270 dmm to 290 dmm according to ASTM D217-10.

In some embodiments, the present invention provides a continuous process for preparing a lithium complex grease, wherein the formulated grease composition has a worked penetration between 280 dmm to 285 dmm according to ASTM D217-10.

In some embodiments, the present invention provides a continuous process for preparing a lithium complex grease, wherein the formulated grease composition has a worked penetration of about 283 dmm according to ASTM D217-10.

In some embodiments, the present invention provides a continuous process for preparing a lithium complex grease, wherein the process conditions afford a production throughput of greater than about 4500 lb/hour, 5500 lb/hour or 6500 lb/hour.

In some embodiments, the present invention provides a continuous process for preparing a lithium complex grease, wherein the process conditions afford a production throughput of about 5500 lb/hour.

In some embodiments, the present invention provides a continuous process for preparing a lithium complex grease, wherein the process further comprises a finishing shear valve pressure of about 100 psig.

In some embodiments, the present invention provides a continuous process for preparing a lithium complex grease, wherein the process conditions afford a formulated grease composition comprising:

a. between about 1.0 wt % to about 1.4 wt % of lithium hydroxide monohydrate;
b. between about 7.0 wt % to about 9.0 wt % of methyl 12-hydroxystearate;
c. between about 3.0 wt % to about 5.0 wt % of an extreme pressure agent;
d. between about 5.0 wt % to about 7.0 wt % of a tackiness agent;
e. between about 3.0 wt % to about 5.0 wt % of a viscosity modifier:
f. between about 1.0 wt % to about 3.0 wt % of a borated additive;
g. between about 0.3 wt % to about 0.9 wt % of a rust inhibitor; and
h. between about 70.0 wt % to about 80.0 wt % of base oil.

In some embodiments, the present invention provides a continuous process for preparing a lithium complex grease, wherein the process conditions afford a formulated grease composition comprising:

a. about 1.219 wt % of lithium hydroxide monohydrate;
b. about 8.225 wt % of methyl 12-hydroxystearate;
c. about 4.136 wt % of an extreme pressure agent;
d. about 6.203 wt % of a tackiness agent;
e. about 4.08 wt % of a viscosity modifier:
f. about 2.046 wt % of a borated additive;
g. about 0.622 wt % of a rust inhibitor; and
h. about 73.469 wt % of base oil.

I. Continuous Process for Preparing Lithium Complex Grease Composition

The continuous grease process of the invention comprises a saponification, dehydration and soap conditioning steps carried out in a continuous manner with recycling of the grease mixture through a shear valve during the soap conditioning step. In the preferred embodiments of the invention, the saponification step is carried out in such a manner that a high degree of turbulence is maintained during the reaction. The process also preferably comprises a cooling and finishing step, which may be carried out by the addition of base oil at a lower temperature than the grease mixture or by passing the grease mixture through a cooler.

Very advantageously, it may be carried out by a combination of these two methods, and with shearing of the grease mixture within a suitable temperature range either during or after the cooling.

The apparatus which the invention provides for carrying out this grease making process comprises a single zone for the dehydration and soap conditioning steps, provided with a recycle line containing a shear valve for recycling the grease mixture from the bottom to the top of the zone with shearing of the recycle stream, and adapted to be operated at a substantially lower pressure than the saponification zone. The saponification zone is preferably a flow type reactor, very suitably comprising a section of pipe having an inside diameter of about 0.5-1.25 inches, and preferably provided with a recycle system for recycling the saponification mixture through the reactor at a sufficient rate to maintain turbulent flow. The apparatus preferably comprises a finishing section with provisions for cooling the grease mixture either by the addition of cold base oil or by passing it through a heat exchanger. An apparatus representing a particularly preferred embodiment of the invention comprises a finishing section wherein the grease may be recycled through a shearing means, such as a shear valve, either during or after this cooling.

In carrying out the process under the preferred conditions, the saponification zone is maintained at an elevated temperature and pressure at least sufficient to maintain the water present in the saponification mixture in the liquid phase, and the dehydration zone is operated at an elevated temperature below the melting point of the soap and under a substantially lower pressure than the saponification zone, so that the major portion of the water is flashed off when the grease mixture enters the dehydration zone. Any remaining water is removed during recycling of the grease mixture through the shear valve, which in effect subjects the grease mixture to a continuous flashing operation by pressure release of the recycle stream through the valve. The recycling is preferably carried out at a rapid rate, such that the grease mixture is subjected to multiple passes through the shear valve operated with at least a substantial pressure drop during the residence time of the grease mixture within the zone. Cooling of the grease mixture is preferably carried out with the addition of base oil at a substantially lower temperature than the grease mixture, and very advantageously in some cases with recycling of the grease mixture through a cooler. The process is also carried out very advantageously in some cases with recycling of the grease mixture through a shearing means during or after the cooling at a temperature within a range which will vary somewhat with the different greases, depending chiefly upon the character of the soap thickener.

Greases of excellent quality are obtained in the above manner in good yields and in greatly reduced manufacturing times as compared with the prior art processes, due in a large measure to the effect upon the soap fiber development of the recycle shearing during the dehydration and soap conditioning steps, and also to the combined effect of this shearing with the effect of carrying out the saponification under turbulent conditions, which provides a grease mixture wherein the soap molecules or micelles are present in a highly dispersed state.

The invention will be better understood from the following description in conjunction with FIG. 1, which is a schematic diagram of an apparatus representing a preferred embodiment of the invention.

Referring to the drawing, 1 is a tubular reactor in the form of a coil, situated inside chamber 2 and connected with lines 6 and 7. Chamber 2 is sealed by flange 3 and provided with inlet line 4 and outlet line 5 for steam or other heating fluid. Vessel 15 contains saponifiable material, or a mixture of saponifiable material and base oil, which is maintained at a temperature above the melting point of the saponifiable material by heating means 16. Ordinarily, vessel 15 will contain a mixture of saponifiable material and base oil comprising at least 10 wt % of the mixture. It is generally preferred to employ a mixture comprising about 20 wt % to 60 wt % of saponifiable material, although lower amounts down to about 5 wt % and also higher amounts up to 100 wt % of saponifiable material may be employed in some cases. Vessel 20 contains a water solution or oil slurry of metal base.

In carrying out the grease making process, the saponifiable material passes at a controlled rate through line 17, containing valve 18 and pump 19 into line 24, while a solution or slurry of metal base passes from tank 20 at a controlled rate through line 21 containing valve 22 and pump 23 into line 24. From line 24 the mixture of saponifiable material and metal base passes through line 25 into line 7 at the intake of pump 10, and from pump 10 it passes through line 6 into zone 1. When the saponification is carried out employing a slurry of the metal base in oil, it is generally desirable to introduce a small amount of water or steam into the reaction zone in order to promote the reaction. The reaction mixture in reaction zone 1 is maintained under superatmospheric pressure at least sufficient to maintain the water present or produced in the reaction in the liquid phase, and at an elevated temperature sufficient to obtain a rapid reaction between the metal base and the saponifiable material. Suitable reaction conditions include broadly pressures in the range from about 10 psig to about 300 psig and temperatures from about 120° C. to about 200° C. The preferred conditions include pressures in the range from about 95 psig to about 170 psig and temperatures in the range from about 160° C. to about 190° C.

The reactant stream is passed through reaction zone 1 at a velocity which is preferably sufficient to maintain turbulent flow within the zone. With special advantage, the reactant stream may be passed through the reaction zone at a velocity resulting in highly turbulent flow, preferably at a velocity resulting in a Reynolds number in the range from about 4,000 to about 100,000. Flow rates required to obtain the desired degree of turbulence are generally within the range from about 0.6 to about 12.0 cubic feet per minute per square inch of reactor cross section. In the process comprising the preferred embodiment of this invention, the saponification mixture is recycled continuously through reactor 1 by way of lines 6 and 7 and pump 10, as a means of obtaining a sufficiently high rate of flow of the reactant stream through the saponification zone. In this manner, a high rate of flow through reaction zone 1 is maintained which is not dependent upon the feed rate, and turbulent flow through the reaction zone can therefore be maintained even with a saponification mixture requiring a relatively long residence time for substantially complete reaction or where an input rate below that required for turbulent flow is required by other conditions of the process. The recycle rate employed is ordinarily in the ratio from about 10:1 to about 100:1 with the rate of throughput, although somewhat lower or higher recycling ratio may be employed in some cases, such as recycle ratio as low as about 1:1 and as high as about 200:1.

Saponification products obtained under the above conditions are especially suitable for use in the subsequent grease making steps of our process because of the readiness with which they accept additional base oil and the shorter soap conditioning periods which they require as compared with grease mixtures obtained under and other saponification conditions. The different physical conditions of these products are shown by the fact that they form grease-like products immediately upon cooling when the saponification mixture contains base oil, differently from saponification products obtained under different conditions including such products obtained in reactors where turbulence is maintained by other means. This different result is presumably due to the severe shearing to which the reaction mixture is subjected when it is passed through a relatively small diameter tube under turbulent flow conditions.

A product stream from reaction zone 1 passes to dehydration zone 30 by way of line 7 and line 26 containing valve 27. Dehydration zone 30 is an upright zone of relatively large diameter as compared with zone 1, sealed by flange 31 and provided with line 32 which is connected to a pressure regulator means (not shown). It may be jacketed or otherwise provided with indirect heating or cooling means. The grease mixture in zone 30 is maintained at an elevated temperature between about 125° C. to about 250° C., but below the melting point of the soap present in the grease mixture, and at a pressure substantially lower than that in reaction zone 1, very suitably under a partial vacuum of from about 5 to about 25 inches of mercury. In the preparation of lithium 12-hydroxystearate thickened greases, the grease mixture in zone 30 is preferably maintained at a temperature in the range from about 160° C. to about 200° C.

During its residence in zone 30, the grease mixture is recycled continuously through line 33, containing pump 34 and valves 35 and 37. Valve 37 is a shear valve, suitably a gate valve, set in a partially closed position so as to give a pressure drop of about 10-200 psi, and preferably about 25-125 psi across the valve. The recycling is preferably carried out at a rapid rate, such that the volume of recycled grease mixture is equal to the total average volume of grease mixture within zone 30 (1 batch turnover) within one minute, and sufficient to provide at least about 5 batch turnovers, and most advantageously at least 10 batch turnovers, during the average residence time of the grease mixture within the zone. The grease residence time in zone 30 may be only sufficient to obtain substantially complete dehydration of the grease mixture, the soap conditioning step in this case taking place simultaneously with the final dehydration stages. It is ordinarily prolonged somewhat so as to provide an additional soap conditioning period, preferably for at least about 5 minutes, particularly when the dehydration is accomplished substantially entirely in the initial flashing operation. In carrying out the process under the preferred conditions, the residence time of the grease mixture in zone 30 may be from a few minutes up to about 1 hour, depending chiefly upon the character of the soap in the grease mixture, and to a less extent upon other factors such as temperature, soap concentration of the grease mixture and character of the base oil. In the preparation of lithium soap thickened greases, a suitable residence time of the grease mixture in zone 30 will usually be from about 5 to about 20 minutes, although somewhat shorter or longer periods may be employed in some cases.

Additional base oil from tank 40 may be added to the grease mixture at various steps in the process in order to obtain the desired soap concentration or to assist in heating or cooling the grease mixture. This additional oil may pass into the grease mixture in line 26 by way of line 41, containing valve 42, line 43 containing pump 44 and valve 45, and line 49 containing valve 50. Additional base oil is added very advantageously in this manner so as to provide at least about 10% of base oil in the grease mixture in line 26 when the saponification is carried out with no base oil or only a small amount of base oil present in the saponification mixture. Such oil addition may also be employed as a means of heating the grease mixture in order to increase the water removal when the grease mixture is flashed into zone 30. The oil added for this purpose is preheated by passing through heater 46 by way of line 43*a*, containing valve 45*a*.

Additionally or alternatively, base oil from tank 40 may pass into the saponification mixture in zone 1 by passing from line 43 through line 47 containing valve 48 and into line 25. Oil added in this manner is employed either in addition to or in place of base oil employed in admixture with the saponifiable material in tank 15. It is preferably preheated in heater 46, very suitably to a temperature in about the range between about 65° C. to about 177° C.

Additionally or alternatively to the base oil addition in the above manner, base oil may be added from tank 40 to the grease mixture during the soap conditioning step. The oil added at this stage of the process may pass into the grease mixture in zone 30 through line 51 containing valve 52. With special advantage in some cases, it may pass through line 53 containing valve 54, into the recycle stream of grease mixture in line 33 as the means of aiding in the recycling when a heavy grease mixture is being circulated, and also as a means of increasing the rate of dehydration by increasing the temperature of the recycle stream in some cases. Additional oil is added in the above manner as required to provide a grease mixture in zone 30 containing at least about 25 wt % of base oil, and preferably at least about 40 wt % of base oil.

In addition to the function of the base oil addition to the grease mixture in zone 30 as a means of obtaining the desired soap concentration, the oil addition may be employed as a means of either heating or cooling the grease mixture to a temperature within the desired soap conditioning temperature range. When the saponification is carried out at a temperature above the melting point of the soap, the oil added to the grease mixture in zone 30 by way of lines 51 or 53 is preferably at a lower temperature than the grease mixture leaving the saponification zone. When the saponification is carried out at a temperature below the desired temperature range for the soap conditioning treatment, the base oil added as described above is preferably preheated. The temperature of the base oil and the amount added may be adjusted so as to give the desired soap concentration in the grease mixture in zone 30 and also to provide a temperature within the desired soap conditioning temperature range.

Indirect heating or cooling of the grease mixture in zone 30 may be employed either in addition or alternatively to the heating or cooling obtained by oil addition as described above. The indirect heating or cooling may be obtained very conveniently by employing a jacketed vessel for zone 30 and passing a heat exchange fluid through the vessel jacket. Very advantageously in some cases, the indirect heating or cooling is applied to the recycle stream of grease mixture in line 33 by passing the grease mixture through heat exchanger 36 by way of line 33*a*, containing valve 35*a*. It is, for example, particularly advantageous in some cases to cool the recycle stream in this manner in order to obtain an increased effect by the shearing, due to the more viscous grease mixture obtained by the cooling.

A stream of substantially dehydrated grease mixture is continuously withdrawn from the recycle stream in line 33 by way of line 75 containing pump 76. Additional base oil may be added to the grease mixture in line 75 from tank 60 by way of line 61 containing valve 62 and line 66 containing pump 67 and valve 68. It is ordinarily preferable to add this oil at a temperature substantially lower than that of the grease mixture, very suitably in some cases at ambient temperature. However, in many cases it is advantageous to preheat the oil by passing it through heat exchanger 70 by way of line 66*a*, containing valve 68*a*, particularly where a high rate of oil addition is employed or where it is desirable to employ a slower cooling rate. Alternatively or additionally, oil may be introduced into line 75 from tank 40 by way of line 41, line 64, containing valve 65, and line 66. Tank 60 is generally employed in conjunction with tank 40 in the process only when two different base oils are employed in the grease.

The additional oil added to the grease mixture in line 79 may amount to as much as about 90 wt % of the total oil in the finished grease. It is ordinarily preferable to carry out the grease preparation with about 20-80 wt % of the total oil contained in the grease added in this manner at a temperature at least about 37° C. below the temperature of the grease mixture in line 75.

From line 75 the grease mixture passes into line 79, containing pump 80 and valves 81 and 83. Valve 81 is a shear valve, such as a gate valve, which may have operated with a substantial pressure drop. Where it is desirable to obtain additional cooling, the grease mixture may pass through cooler 85, by way of line 79*a*, containing valve 83*a*. Recycling of the grease mixture through line 79 by way of line 89 may be employed in order to obtain multiple passes through shearing valve 81 and cooler 85. From line 79 a stream of the grease mixture is taken off through line 87, containing valve 88. Additional base oil at the same or a lower temperature may be added to this stream of the grease mixture by way of line 71, containing valve 72, either alternatively or in addition to the base oil added through line 66 as described above. When additional oil is added in this manner it becomes mixed with the grease mixture as the combined steam passes through valve 88, which is operated as a shear valve. The stream of grease mixture containing oil added in this manner may pass through additional shearing means it desired.

Any additives employed in the grease are preferably introduced into the grease mixture during the cooling, ordinarily where the grease mixture is below about 121° C. As shown in FIG. 1, the additives may be added from one or more of tank 90 by way of line 91, containing valve 92 and pump 93 into the grease mixture in line 75 after the addition of base oil from line 66. When the grease mixture at this point is not at a suitably low temperature, the additives may be added at some later point in the cooling and finishing section. Advantageously, the invention herein relates to elimination of the conventional dibasic acid salt or dibasic ester component. These conventional thickener or complexing agent components are substituted with a borated additive fed into the grease mixture during addition of the additives. This substitution and process modification results in a significantly less problematic process and a substantial increase in production throughput.

It is ordinarily advantageous to recycle the grease mixture through shear valve 81 operated with a pressure drop in about the range 20-200 psig, employing a recycle ratio from about 1:1 to about 100:1 and preferably from about 5:1 to about 50:1. Shearing in this manner is preferably carried out upon the grease mixture at a temperature below about 150° C., and most advantageously in most cases at a temperature within the range from about 65° C. to about 121° C.

The metal base employed in the saponification may be a hydroxide or other suitable basic reacting compound of any of the metals ordinarily employed as the metal component of the soap in the preparation of lubricating greases, such as sodium, lithium, potassium, calcium, barium, magnesium, zinc, cobalt, manganese, aluminum, lead, etc. as well as mixtures of two or more metals. It is preferably a metal oxide, hydroxide or carbonate. The greases which are most advantageously prepared by the method of this invention are those wherein the soap thickener is an alkali metal or alkaline earth metal soap, or a mixture of two or more soaps of these classes.

Suitable saponifiable materials for use in these grease preparations comprise higher fatty acids containing from about 12 to 32 carbon atoms per molecule and hydroxy substituted higher fatty acids, their glycerides and other esters and mixtures thereof. The invention also contemplates grease preparations carried out in the manner described above wherein such higher fatty acid materials are employed in conjunction with lower fatty acid materials, such as fatty acids containing from 1 to about 6 carbon atoms per molecule, their glycerides and other esters. Such lower fatty acid materials may be employed in amounts giving a mol ratio of lower fatty acid to higher fatty acid from below 1:1 up to about 20:1, respectively. Also, intermediate fatty acid materials may be employed in conjunction with the higher fatty acid materials in varying amounts, ordinarily in amounts giving a mol ratio with the higher fatty acid material below about 1:1, respectively.

The base oils employed in these greases may be any base oil having lubricating characteristics, including one or more of bright stock base oil, Group I base oil, Group II base oil, Group II+ base oil, Group III base oil, Group IV base oil, 150R, 600R, 110RLV, 220R, 100R or combinations thereof. They may be either naphthenic or paraffinic in type, or blends of two or more oils of these different types.

In the production of greases from synthetic oils which are hydrolyzed under the saponification conditions, the saponification is preferably carried out in the absence of any such base oil or of a minor amount of such base oil which is substantially inert under the saponification conditions such as a mineral oil and the synthetic oil added at later stages of the grease making process described herein.

II. Lithium Complex Grease Composition

Base oils are the most important component of grease compositions, generally comprising greater than 70% of the grease compositions. Grease compositions comprise a base oil and at least one additive. Grease compositions can be used in automobiles, diesel engines, axles, transmissions, and industrial applications. Grease compositions must meet the specifications for their intended application as defined by the concerned governing organization. Typical additives and their function are described in Modern Lubricating Greases by C. J. Boner, Scientific Publication (G.B.) Ltd. 1976.

Additives, which can be blended with the base oil, to provide a lubricant composition include those which are intended to improve select properties of the lubricant composition. Typical additives include, for example, ionic surfactants, non-ionic surfactants, anti-oxidants, anti-wear additives, extreme pressure agents, corrosion inhibitors, rust inhibitors, thickeners (i.e., gelling agents), oiliness agents, metal deactivators, oil bleed inhibitors such as polybutene, shear stability additives, pour point depressants such as polymethyl methacrylate, complex organic nitrogen, and amines, thermal conductive additives, electroconductive agents, elastomeric compatibilizers, viscosity modifiers, friction modifiers, tackiness agents, bactericides and fungicides, polymeric compounds, colorants, and the like. Additives can be added in the form of an additive package, containing various additives.

Borated Additives:

The grease composition may comprise a borated additive for improving the high-temperature properties (i.e., improving the dropping point) of lithium based grease compositions. For instance, examples of borated additives may be found in U.S. Pat. Nos. 4,780,227; 4,743,386; 4,781,850; 4,828,732; 4,828,734; 5,242,045; 5,242,610; and 5,252,237. However, the borated additives described are not to be limited in scope by the specific embodiments described in said U.S. patents.

Metal Deactivators:

The grease composition may comprise metal deactivators such as disalicylidene propylenediamine, triazole derivatives, thiadiazole derivatives, mercaptobenzimidazoles; complex organic nitrogen, and amines.

Flame Retardants:

The grease composition may comprise flame retardants such as calcium oxide.

Tackiness Agents:

The grease composition may comprise tackiness agents such as polyisobutylene (PIB).

Thickeners (Gelling Agents):

The thickener may be any material that, in combination with the base oil, will produce the solid to semi-fluid structure. In this aspect, a grease thickener in combination with the base oil acts much the same way as a sponge holding water. Principal thickeners used in greases include lithium, aluminum, sodium, and calcium soaps and their complexes; clay; polyurea, diurea, silica, alumina, over-based calcium sulfonates; either alone or in combination.

The thickener system may comprise a lithium complex soap of a $C_{12}$ to $C_{24}$ hydroxy fatty acid or a $C_{12}$ to $C_{24}$ hydroxy fatty acid ester and a borated additive. Suitable $C_{12}$ to $C_{24}$ hydroxy fatty acids can include 12-hydroxystearic acid, 12-hydroxyricinoleic acid, 12-hydroxybehenic acid and 10-hydroxypalmitic acid. In one embodiment, the $C_{12}$ to $C_{24}$ hydroxy fatty acid is 12-hydroxystearic acid. The amount of lithium complex thickener in the lubricating grease composition may range from 2 to 30 wt %, from 5 to 20 wt % or 10 to 15 wt %, based on the total weight of the grease composition.

Corrosion Inhibitors (Anti-Corrosive Agents):

These additives are typically added to reduce the degradation of the metallic parts and present in amounts from about 0.02 to 1 wt %. Examples include zinc dialkyldithiophosphate, phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester. The rust inhibitor or anticorrosion agents may be a non-ionic polyoxyethylene surface active agent. Nonionic polyoxyethylene surface active agents include, but are not limited to, polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate. Rust inhibitors or anticorrosion agents may also be other compounds, which include, for example, stearic acid and other fatty acids, dicarboxylic acids, metal soaps, fatty acid amine salts, metal salts of heavy sulfonic acid, partial carboxylic acid ester of polyhydric alcohols, and phosphoric esters. The rust inhibitor may be a calcium stearate salt.

Viscosity Index Improvers (Modifiers):

The viscosity index of an base oil can be increased, or improved, by incorporating therein certain polymeric materials that function as viscosity modifiers (VM) or viscosity index improvers (VII) in an amount of 0.3 to 25 wt %. of the final weight of the base oil. Examples include but are not limited to olefin copolymers, such as ethylene-propylene copolymers, styrene-isoprene copolymers, hydrated styrene-isoprene copolymers, polybutene, polyisobutylene, polymethacrylates, vinylpyrrolidone and methacrylate copolymers and dispersant type viscosity index improvers. These viscosity modifiers can optionally be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers).

Other examples of viscosity modifiers include star polymers (e.g., a star polymer comprising isoprene/styrene/isoprene triblock). Yet other examples of viscosity modifiers include poly alkyl(meth)acrylates of low Brookfield viscosity and high shear stability, functionalized poly alkyl(meth)acrylates with dispersant properties of high Brookfield viscosity and high shear stability, polyisobutylene having a weight average molecular weight ranging from 700 to 2,500 Daltons and mixtures thereof.

Friction Modifiers:

The grease composition may comprise at least a friction modifier (e.g., a sulfur-containing molybdenum compound). Certain sulfur-containing organo-molybdenum compounds are known to modify friction in grease compositions, while also offering antioxidant and antiwear credits. Examples of oil soluble organo-molybdenum compounds include molybdenum succinimide complex, dithiocarbamates, dithiophosphates, dithiophosphinates, xanthates, thioxanthates, sulfides, and the like, and mixtures thereof.

Other examples include at least a mono-, di- or triester of a tertiary hydroxyl amine and a fatty acid as a friction modifying additive. Other examples are selected from the group of succinamic acid, succinimide, and mixtures thereof. Other examples are selected from an aliphatic fatty amine, an ether amine, an alkoxylated aliphatic fatty amine, an alkoxylated ether amine, an oil-soluble aliphatic carboxylic acid, a polyol ester, a fatty acid amide, an imidazoline, a tertiary amine, a hydrocarbyl succinic anhydride or acid reacted with an ammonia or a primary amine, and mixtures thereof.

Oxidation Inhibitors/Antioxidants:

Oxidation inhibitors or antioxidants reduce the tendency of mineral oils to deteriorate in service, which deterioration is evidenced by the products of oxidation such as sludge, lacquer, and varnish-like deposits on metal surfaces. The grease composition may contain from about 50 ppm to about 5.00 wt % of at least an antioxidant selected from the group of phenolic antioxidants, aminic antioxidants, or a combination thereof. The amount of antioxidants may be between 0.10 to 3.00 wt %. The amount of antioxidants may be between about 0.20 to 0.80 wt %. An example of an antioxidant used is di-$C_8$-diphenylamine, in an amount of about 0.05 to 2.00 wt % of the total weight of the oil composition. Other examples of antioxidants include MoS and Mo oxide compounds.

Other examples of antioxidants include hindered phenols; alkaline earth metal salts of alkylphenolthioesters having $C_5$ to $C_{12}$ alkyl side chains; calcium nonylphenol sulphide; oil soluble phenates and sulfurized phenates; phosphosulfurized or sulfurized hydrocarbons or esters; phosphorous esters; metal thiocarbamates; oil soluble copper compounds known in the art; phenyl naphthyl amines such as phenylene diamine, phenothiazine, diphenyl amine, diarylamine; phenylalphanaphthylamine, 2,2'-diethyl-4,4'-dioctyl diphenylamine, 2,2'diethyl-4-t-octyldiphenylamine; alkaline earth metal salts of alkylphenol thioesters, having $C_5$ to $C_{12}$ alkyl side chains, e.g., calcium nonylphenol sulfide, barium t-octylphenol sulfide, zinc dialkylditbiophosphates, dioctylphenylamine, phenylalphanaphthylamine and mixtures thereof. Some of these antioxidants further function as corrosion inhibitors. Other suitable antioxidants which also function as antiwear agents include bis alkyl dithiothiadiazoles such as 2,5-bis-octyl dithiothiadiazole.

Anti-Wear Agents:

Anti-wear agents can also be added to the grease composition. The composition may comprise at least an anti-wear agent selected from phosphates, phosphites, carbamates, esters, sulfur containing compounds, and molybdenum complexes. Other representative of suitable antiwear agents are zinc dialkyldithiophosphate, zinc diaryldilhiophosphate, Zn or Mo dithiocarbamates, phosphites, amine phosphates, borated succinimide, magnesium sulfonate, and mixtures thereof. The composition may comprise at least a dihydrocarbyl dithiophosphate metal as antiwear and antioxidant agent in amounts of about 0.1 to about 10 wt %. The metal may be an alkali or alkaline earth metal, or aluminum, lead, tin, molybdenum, manganese, nickel or copper.

Extreme Pressure Agents:

The grease composition may comprise an extreme pressure agent. Examples include alkaline earth metal borated extreme pressure agents and alkali metal borated extreme pressure agents. Other examples include sulfurized olefins, zinc dialky-1-dithiophosphate (primary alkyl, secondary alkyl, and aryl type), di-phenyl sulfide, methyl tri-chlorostearate, chlorinated naphthalene, fluoroalkylpolysiloxane, lead naphthenate, neutralized or partially neutralized phosphates, dithiophosphates, and sulfur-free phosphates.

The grease composition may comprise multifunctional additives such as sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound and the like.

The grease composition may comprise solid materials such as graphite, molybdenum disulfide, polytetrafluoroethylene, talc, metal powders, calcium carbonate, calcium oxide, calcium hydroxide, boron nitride, titanium oxide, zinc oxide, and various polymers such as polyethylene wax can also be added to impart special properties.

Some of the above-mentioned additives can provide a multiplicity of effects; thus for example, a single additive may act as a dispersant as well as an oxidation inhibitor. These multifunctional additives are well known. Furthermore, when the grease composition contains one or more of the above-mentioned additives, each additive is typically blended into the base oil in an amount that enables the additive to provide its desired function. It may be desirable, although not essential to prepare one or more additive concentrates comprising additives (concentrates sometimes being referred to as "additive packages") whereby several additives can be added simultaneously to form the end grease compositions. The final composition may employ from about 0.5 to about 30 wt % of the concentrate. The components can be blended in any order and can be blended as combinations of components.

DEFINITIONS AND TERMS

The following terms will be used throughout the specification and will have the following meanings unless otherwise indicated.

The term "Group I Base Oil", refers to a base oil which contains less than 90 percent saturates and/or greater than 0.03 percent sulfur and have a viscosity index greater than or equal to 80 and less than 120 using the ASTM methods specified in Table E-1 of American Petroleum Institute Publication 1509.

The term "Group II Base Oil", refers to a base oil which contains greater than or equal to 90% saturates and less than or equal to 0.03% sulfur and has a viscosity index greater than or equal to 80 and less than 120 using the ASTM methods specified in Table E-1 of American Petroleum Institute Publication 1509.

The term "Group II+ Base Oil", refers to a Group II base oil having a viscosity index greater than or equal to 110 and less than 120.

The term "Group III Base Oil", refers to a base oil which contains greater than or equal to 90% saturates and less than or equal to 0.03% sulfur and has a viscosity index greater than or equal to 120 using the ASTM methods specified in Table E-1 of American Petroleum Institute Publication 1509.

The term "Bright Stock Base Oil", refers to a heavy Group I base oil with a viscosity index of about 90 and a kinematic viscosity of about 30 cSt at 100° C. Bright stock base oil is a high viscosity, fully refined, and dewaxed lubricating oil base stock usually produced by suitable treatment of petroleum residues. For example, the bright stock base oil of the present invention may have a viscosity of 31 cSt at 100° C. 150 Bright Stock (HollyFrontier™ SN 150 Bright Stock) is an example of such a bright stock base oil of the invention herein.

The term "Grading", refers to an amount of base oil being added to adjust the consistency of the grease composition.

The term "Petroleum Derived", means that the product, fraction, or feed originates from the vapor overhead streams from distilling petroleum crude and the residual fuels that are the non-vaporizable remaining portion. A source of the petroleum derived product, fraction, or feed can be from a gas field condensate.

The term "Aromatics", means any hydrocarbonaceous compounds that contain at least one group of atoms that share an uninterrupted cloud of delocalized electrons, where the number of delocalized electrons in the group of atoms corresponds to a solution to the Huckel rule of 4n+2 (e.g., n=1 for 6 electrons, etc.). Representative examples include, but are not limited to, benzene, biphenyl, naphthalene, and the like.

The term "ASTM Standard D217-10", refers to a standard test method for the Cone Penetration of Lubricating Grease. These cone penetration tests not only evaluate the consistency of lubricating greases over the full range of NLGI numbers from 000 to 6, but also evaluate the consistency of stiff greases having penetration numbers less than 85. Cone penetration test results provide one measure of the consistency of a grease. Worked penetration results are required to determine to which NLGI consistency grade a grease belongs. Undisturbed penetration results provide a means of evaluating the effect of storage conditions on grease consistency. The test method is designed for measuring the consistency of lubricating greases by the penetration of a cone of specified dimensions, mass, and finish. The penetration is measured in tenths of a millimeter.

The term "ASTM Standard D2265" or D2265", refers to a standard test method for Dropping Point of a lubricating grease over a wide temperature range. As grease temperature increases, penetration increases until the grease liquefies and the desired consistency is lost. The dropping point is the temperature at which a grease becomes fluid enough to drip. A summary of the D2265 test method as follows:

(a) A grease sample in a grease test cup is supported in a test tube placed in an aluminum block oven at a preset constant temperature. A sample thermometer is placed in the tube and so positioned that it measures the temperature in the sample cup without coming in contact with the grease.

(b) As the temperature increases, at some point a drop of material will fall from the cup to the bottom of the test tube. The reading on the sample thermometer is recorded to the nearest degree as the observed dropping point. At the same time, the temperature of the aluminum block oven is also recorded to the nearest degree.

(c) One third the difference between the two values is the correction factor which is added to the observed value and recorded as the dropping point of the grease.

The term "ASTM Standard D566" or D566", refers to a standard test method for dropping point of a lubricating grease over a wide temperature range. A summary of the D566 test method as follows: A sample of lubricating grease contained in a cup suspended in a test tube is heated in an oil bath at a prescribed rate. The temperature at which material falls from the hole in the bottom of the cup is averaged with the temperature of the oil bath and recorded as the dropping point of the grease.

The term "Kinematic viscosity", refers to a measurement of the resistance to flow of a fluid under gravity. Many base oils, lubricant compositions made from them, and the correct operation of equipment depends upon the appropriate viscosity of the fluid being used. Kinematic viscosity is determined by ASTM D445-06. The results are reported in $mm^2/s$ and cSt.

The term "Viscosity index (VI)", refers to an empirical, unitless number indicating the effect of temperature change on the kinematic viscosity of the oil. Viscosity index is determined by ASTM D2270-04.

The term "Pour point", refers to a measurement of the temperature at which a sample of base oil will begin to flow under carefully controlled conditions. Pour point can be determined as described in ASTM D5950-02. The results are reported in degrees Celsius. Many commercial base oils have specifications for pour point. When base oils have low pour points, the base oils are also likely to have other good low temperature properties, such as low cloud point, low cold filter plugging point, and low temperature cranking viscosity.

The term "Noack volatility", refers to a test according to ASTM D5800-05 Procedure B. A more convenient method for calculating Noack volatility and one which correlates well with ASTM D5800-05 is by using a thermogravimetric analyzer (TGA) test by ASTM D6375-05. TGA Noack volatility is used throughout the present disclosure unless otherwise stated.

The terms "100R, 150R, 220R, 600R and 110RLV", refer to base oils defined as presented in Table 1 shown below.

TABLE 1

| Property | ASTM Method | 100R | 150R | 220R | 600R | 110RLV |
|---|---|---|---|---|---|---|
| API Base Oil Category | API 1509 E 1.3 | II | II | II | II | II(+) |
| Appearance | SM 360-99 | Bright and Clear | Bright and Clear | Bright and Clear | Bright and Clear | Bright and Clear |
| Color | ASTMD 1500 | L0.5 | L0.5 | L0.5 | L0.5 | L0.5 |
| API Gravity, deg. | ASTM D 4052 | 34.4 | 33.4 | 31.9 | 31.2 | 35.4 |
| Density, lb/gal | ASTM D 4052 | 7.1 | 7.15 | 7.22 | 7.28 | 7.06 |
| Density, kg/l | ASTM D 4052 | 0.853 | 0.858 | 0.867 | 0.874 | 0.848 |
| Specific Gravity, @ 60° F./60° F. | ASTM D 4052 | 0.853 | 0.858 | 0.867 | 0.874 | 0.848 |
| Viscosity @ 40° C., cSt | ASTM D 445 | 20.3 | 30.9 | 43.7 | 108 | 21.1 |
| Viscosity @ 100° C., cSt | ASTM D 445 | 4.1 | 5.3 | 6.6 | 12.2 | 4.4 |
| Viscosity @ 100° F., SUS | ASTM D 2161 | 107 | 153 | 214 | 590 | 113 |
| Viscosity Index | ASTM D 2270 | 102 | 107 | 102 | 103 | 118 |
| CCS @ −20° C., cP | ASTM D 5293 | N/A | 1750 | 3400 | N/A | 822 |
| CCS @ −25° C., cP | ASTM D 5293 | 1400 | 2660 | 5600 | N/A | 1350 |
| CCS @ −30° C., cP | ASTM D 5293 | 2650 | 5070 | N/A | N/A | 2450 |
| Pour Point, ° C. | ASTM D 5950/1C | −15 | −15 | −13 | −17 | −15 |
| Flash Point, COC, ° C. | ASTM D 92 | 206 | 227 | 230 | 270 | 216 |
| Volatility, wt. % distilled at 700° F./371° C. | ASTM D 2887 | 13 | N/A | N/A | N/A | N/A |
| Evaporative Loss, NOACK, wt % | ASTM D5800 (B) | 26 | 14 | 10 | 2 | 16 |
| Water, ppm | ASTM D 6304-98 | <50 | <50 | <50 | <50 | <50 |
| Sulfur, ppm | ICP/XRF | <10 | <10 | <10 | <10 | <6 |
| Saturates, HPLC wt. % | Chevron | >99 | >99 | >99 | >99 | >99 |
| Aromatics, HPLC wt. % | Chevron | <1 | <1 | <1 | <1 | <1 |

N/A refers to not available.

The term "150 Bright Stock", refers to a base oil defined as presented in Table 2 shown below.

TABLE 2

| Property | ASTM Method | 150R Bright Stock |
|---|---|---|
| Appearance | N/A | Dark viscous |
| Boiling Point | D2887 | N/A |
| Bulk Density | D1250 | 7.42 lb/gal |

TABLE 2-continued

| Property | ASTM Method | 150R Bright Stock |
|---|---|---|
| Pour Point | D97 | −9° C. |
| Molecular Weight | D2502 | 690 g/mol |
| Specific Gravity | D1298 | 0.89 |
| Odor | N/A | Slight |
| Vapor Pressure | N/A | <0.0001 mmHg @ 20° C. |
| Viscosity (° F.) | D2161 | 2636 SUS @ 100° F. |
| Viscosity (° C.) | D445 | 491.4 cSt @ 40° C. |
| % Volatility | D2369 | Nil |

N/A refers to not available.

Unless otherwise indicated herein, scientific and technical terms used in connection with the present invention shall have the meanings that are commonly understood by those of ordinary skill in the art. Further, unless otherwise required by context, singular terms shall include pluralities and plural terms shall include the singular. More specifically, as used in this specification and the appended claims, the singular forms "a", "an" and "the" include plural referents unless the context clearly dictates otherwise. Thus, for example, reference to "a fatty acid" includes a plurality of fatty acids, and the like. In addition, ranges provided in the specification and appended claims include both end points and all points between the end points. Therefore, a range of 2.0 to 3.0 includes 2.0, 3.0 and all points between 2.0 and 3.0. Furthermore, all numbers expressing quantities, percentages or proportions, and other numerical values used in the specification and claims, are to be understood as being modified in all instances by the term "about". As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

EXAMPLES

The following examples are provided to demonstrate particular embodiments of the present invention. It should be appreciated by those of skill in the art that the methods disclosed in the examples which follow merely represent exemplary embodiments of the present invention. However, those of skill in the art should, in light of the present disclosure, appreciate that many changes can be made in the specific embodiments described and still obtain a like or similar result without departing from the spirit and scope of the present invention.

Example 1

Lithium 12-Hydroxy Stearate-Organoborate Complex Soap Thickened Grease

The apparatus employed in the preparation (continuous process unit) and the operating conditions used were the same as Example 1. The apparatus employed in the preparation comprised a coil reactor, a dehydrator, a shearing device, and a cooler, with auxiliary equipment for circulating the grease mixture through each of these zones as well as for introducing reactants and additional base oil, moving the grease mixture between the zones and withdrawing a product stream. The details of the equipment and process used are described in Section I above.

The soap base heat exchanger was set to 360° F. The reactor temperature and pressure were set to 350° F. and 150 psig, respectively. The dehydration zone temperature and pressure were set to 360° F. and 15.7 psig, respectively. The dehydration zone level was set to 50.5% and the dehydration zone shear was set to 80 psig. The cooler temperature was set to 200° F. The finishing section shear pressure was set to 100 psig, as was the finished product pressure.

A preheated base oil mixture, consisting of 90% of a Group II neutral mineral oil (Chevron Neutral Oil 600R) of viscosity 110 cSt at 40° C. and 10% of a Group I mineral bright stock (Holly SN 150 Bright Stock) of viscosity 31 cSt at 100° C., was fed into the front of the continuous process unit ahead of the reactor at a rate of 23.72 lb/min. At the same point in the continuous process unit, heated methyl 12-hydroxystearate was added at a rate of 4.49 lb/min. Also at the same point in the continuous process unit, an 18% solution of lithium hydroxide monohydrate in water was added at a rate of and 3.59 lb/min. After recirculation in the reactor, the reaction mixture was fed into the dehydration zone section. Following recirculation in the dehydration zone, the reacted and dehydrated simple-soap thickener mixture was combined with a borated additive, other additives, and additional oil before final shearing. After the dehydration zone section, a mixture of 33.3% viscosity modifier, 16.7% borated additive, and 50% of the base oil mixture, consisting of 90% of a Group II neutral mineral oil of viscosity 110 cSt at 40° C. and 10% of a Group 1 mineral bright stock of viscosity 31 cSt at 100° C., was added to the continuous process unit at a rate of 7.0 lb/min. At the same point, a mixture of 37.5% tackifier additive, 25.0% extreme pressure agent, and 50% of the base oil mixture, consisting of 90% of a Group II neutral mineral oil of viscosity 110 cSt at 40° C. and 10% of a Group 1 mineral bright stock of viscosity 31 cSt at 100° C., was added to the continuous process unit at a rate of 9.33 lb/min. Also at the same point, a mixture of 33.3% rust inhibitor and 66.7% of the base oil mixture, consisting of 90% of a Group II neutral mineral oil of viscosity 110 cSt at 40° C. and 10% of a Group 1 mineral bright stock of viscosity 31 cSt at 100° C., was added to the process at a rate of 1.05 lb/min. At the same point additional mineral oil was added for cooling and grading, consisting of 90% of a Group II neutral mineral oil of viscosity 110 cSt at 40° C. and 10% of a Group 1 mineral bright stock of viscosity 31 cSt at 100° C., at a rate of 16.77 lb/min. The grease mixture was then recirculated in the shearing section followed by the cooling section. The finished grease was accumulated from the continuous process unit in a conventional grease mixer for sampling and testing as shown in Tables 3 and 5.

The total production volume of this run was approximately 32,500 lb at an average production rate of 5,500 lb/hour as shown in Table 4. The average dropping point at the time of manufacture was 268° C. and the worked penetration was 283 dmm.

TABLE 3

Final QC Lab Results

| Test | Measured Result | Specification |
|---|---|---|
| Worked Penetration | 283 dmm | 270-290 |
| Dropping Point | 268° C. | 240 min |
| Dropping Point (next morning) | 259° C. | 240 min |

TABLE 4

Batch Information

| | |
|---|---|
| Starting Production Rate | 3,500 lb/hr |
| Production Rate (last ⅔ of Batch) | 5,500 lb/hr |
| Total Grease Produced | 32,571 lb |
| Time to line out unit | |
| Actual run time | |

TABLE 5

| Component | Example 2 Target Formula Wt % | Example 2 Actual Wt % |
|---|---|---|
| Lithium Hydroxide Monohydrate | 1.080 | 1.219 |
| Methyl 12-Hydroxystearate | 7.700 | 8.225 |
| Extreme Pressure Agent | 4.000 | 4.136 |
| Tackiness Agent | 6.000 | 6.203 |
| Viscosity Modifier | 4.000 | 4.080 |
| Borated Additive | 2.000 | 2.046 |
| Rust Inhibitor | 0.600 | 0.622 |
| Base Oil Mix | 74.620 | 73.469 |
| | 100.000 | 100.000 |

Comparative Example 1

Lithium 12-Hydroxy Stearate-Azelate Mixture Complex Soap Thickened Grease

The apparatus employed in the preparation (continuous process unit) comprised a coil reactor, a dehydrator, a shearing device, and a cooler, with auxiliary equipment for circulating the grease mixture through each of these zones as well as for introducing reactants and additional base oil, moving the grease mixture between the zones and withdrawing a product stream. The details of the equipment and process used are described in Section I above.

The soap base heat exchanger was set to 360° F. The reactor temperature and pressure were set to 350° F. and 150 psig, respectively. The dehydration zone temperature and pressure were set to 360° F. and 15.7 psig, respectively. The dehydration zone level was set to 50.5% and the dehydration zone shear was set to 80 psig. The cooler temperature was set to 200° F. The finishing section shear pressure was set to 100 psig, as was the finished product pressure.

A preheated base oil mixture, consisting of 90% of a Group II neutral mineral oil (Chevron Neutral Oil 600R) of viscosity 110 cSt at 40° C. and 10% of a Group I mineral bright stock (Holly SN 150 Bright Stock) of viscosity 31 cSt at 100° C. was fed into the continuous process unit ahead of the reactor at a rate of 22.06 lb/min. At the same point in the continuous process unit, heated methyl 12-hydroxystearate and heated dimethyl sebacate were added at a rate of 3.87 lb/min and 0.35 lb/min, respectively. Also at the same point in the continuous process unit, an 18% solution of lithium hydroxide monohydrate in water was added at a rate of 3.98 lb/min. After recirculation in the reactor, the reaction mixture was fed into the dehydration zone section. Following recirculation in the dehydration zone section, the reacted and dehydrated thickener mixture was combined with additives and additional oil before final shearing. After the dehydration zone section, a mixture of 50% viscosity modifier and 50% of the base oil mixture, consisting of 90% of a Group II neutral mineral oil of viscosity 110 cSt at 40° C. and 10% of a Group 1 mineral bright stock of viscosity 31 cSt at 100° C., was added to the continuous process unit at a rate of 4.67 lb/min. At the same point in the continuous process unit, a mixture of 60% tackifier additive and 40% extreme pressure agent was added to the continuous process unit at 5.83 lb/min. Also at the same point in the continuous process unit, a mixture of 16.7% non-ionic surfactant, 33.3% rust inhibitor, and 50% of the base oil mixture, consisting of 90% of a Group II neutral mineral oil of viscosity 110 cSt at 40° C. and 10% of a Group 1 mineral bright stock of viscosity 31 cSt at 100° C., was added to the process at a rate of 1.05 lb/min. At the same point in the continuous process unit, additional mineral oil was added for cooling and grading, consisting of 90% of a Group II neutral mineral oil of viscosity 110 cSt at 40° C. and 10% of a Group 1 mineral bright stock of viscosity 31 cSt at 100° C., at a rate of 19.8 lb/min. The grease mixture was then recirculated in the shearing section of the continuous process unit followed by the cooling section. The finished grease was accumulated from the continuous process unit in a conventional grease mixer for sampling and testing.

The total production volume of this run was approximately 90,000 lb at an average production rate of 3,500 lb/hour. The average dropping point at the time of manufacture was 234° C. and the worked penetration was 278 dmm.

Discussion: The finished lithium complex grease in Example 1 was produced by substituting additive borated additive for the thickener complexing agent of dilithium sebacate. Example 1 was successful in that it was produced very close to the target formula, suffered no production issues, and met all release requirements for the finished lithium complex grease produced. The finished-grease yield and the production rate were essentially the same as for simple lithium soap greases, and also considerably better than that of a lithium complex grease in this same production unit as presented with Comparative Example 1.

All patents, patent applications and publications are herein incorporated by reference to the same extent as if each individual patent, patent application or publication was specifically and individually indicated to be incorporated by reference.

The present invention if not to be limited in scope by the specific embodiments described herein, which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications are intended to fall within the scope of the appended claims.

What is claimed is:

1. A continuous process for preparing a lithium complex grease, comprising:

a. heating a mixture of a $C_{12}$ to $C_{24}$ hydroxy fatty acid or a $C_{12}$ to $C_{24}$ hydroxy fatty acid ester, an aqueous solution of lithium base and at least one base oil in a reaction zone at a temperature between about 120° C. to about 200° C. under turbulent mixing conditions;

b. passing the mixture of Step (a) through a heat exchanger raising the temperature of the mixture to between about 150° C. to about 200° C.;

c. transferring the mixture of Step (b) to a dehydration zone which is maintained at temperature between about 125° C. to about 225° C.; and d. transferring the mixture of Step (c) to a recycle line and adding grease additives, a borated additive for improving the high-temperature properties, and at least one base oil under turbulent mixing conditions to afford a formulated complex grease composition, wherein the continuous process does not include adding a dibasic acid or dibasic ester component and wherein the formulated complex grease composition has a dropping point greater than about 240° C. according to ASTM D2265.

2. The process of claim 1, wherein the hydroxy fatty acid is 12-hydroxy stearic acid.

3. The process of claim 1, wherein the hydroxy fatty acid ester is the methyl or ethyl ester of 12-hydroxy stearic acid.

4. The process of claim 1, wherein the temperature of Step (a) is between about 160° C. to about 190° C. and the pressure is between about 95 psig to about 170 psig.

5. The process of claim 1, wherein the lithium base is selected from the group consisting of lithium oxide, lithium hydroxide, lithium hydroxide monohydrate and lithium carbonate.

6. The process of claim 1, wherein the base oil is a bright stock base oil, Group I base oil, Group II base oil, Group II+ base oil, Group III base oil, Group IV base oil, 150R, 600R, 110RLV, 220R, 100R or combinations thereof.

7. The process of claim 6, wherein the base oil is a combination of a bright stock base oil with a viscosity of 31 cSt at 100° C. and a Group II base oil with a viscosity of 110 cSt at 40° C.

8. The process of claim 6, wherein the base oil is a combination of a 150 bright stock base oil and 600R.

9. The process of claim 1, wherein the aqueous solution of lithium base of Step (a) is between about 16 wt % to about 20 wt % aqueous lithium hydroxide.

10. The process of claim 9, wherein the aqueous solution of lithium base is approximately a 18 wt % lithium hydroxide solution and is added in the required stoichiometric amount plus a 0.05 wt % to 0.2 wt % excess along with a quantity of base oil sufficient to give total theoretical soap concentration of from about 10 weight percent up to about 40 weight percent.

11. The process of claim 1, wherein the heat exchanger of Step (b) raises temperature of the mixture between about 170° C. to about 190° C. at a pressure between about 10 psig to about 40 psig.

12. The process of claim 1, wherein the dehydration zone temperature of Step (c) is between about 160° C. to about 200° C. and the pressure is between about 10 psig to about 20 psig.

13. The process of claim 12, wherein the Step (c) further comprises a step of shearing the mixture through a shear valve having a pressure difference across the shear valve between about 70 to about 90 psig.

14. The process of claim 1, wherein Step (c) further comprises dehydration of the mixture that is partially accomplished by reduction of pressure on the mixture between the reaction zone and the dehydration zone.

15. The process of claim 1, wherein the grease additives of Step (d) are selected from the group consisting of an antioxidant, a tackiness agent, a viscosity modifier, a non-ionic surfactant, a corrosion inhibitor, a rust inhibitor, a wear inhibitor, an extreme pressure agent, a polymeric compound, and mixtures thereof.

16. The process of claim 1, wherein the process further comprises recycling the formulated complex grease composition formed in Step (d) through a cooler set to a temperature between about 80° C. to about 105° C. and a shear valve.

17. The process of claim 1, wherein the formulated complex grease composition temperature is between about 80° C. to about 121° C.

18. The process of claim 1, wherein the formulated complex grease composition has a dropping point greater than about 250° C. according to ASTM D2265.

19. The process of claim 1, wherein the formulated grease composition has a worked penetration between 270 dmm to 290 dmm according to ASTM D217-10.

20. The process of claim 1, wherein the process conditions afford a production throughput of greater than about 4500 lb/hour.

21. The process of claim 1, wherein the process conditions afford a production throughput of about 5500 lb/hour.

22. The process of claim 1, wherein the process conditions afford a formulated complex grease composition comprising:

a. between about 1.0 wt % to about 1.4 wt % of lithium hydroxide monohydrate;
b. between about 7.0 wt % to about 9.0 wt % of methyl 12-hydroxystearate;
c. between about 3.0 wt % to about 5.0 wt % of an extreme pressure agent;
d. between about 5.0 wt % to about 7.0 wt % of a tackiness agent;
e. between about 3.0 wt % to about 5.0 wt % of a viscosity modifier:
f. between about 1.0 wt % to about 3.0 wt % of a borated additive;
g. between about 0.3 wt % to about 0.9 wt % of a rust inhibitor; and
h. between about 70.0 wt % to about 80.0 wt % of base oil.

23. The process of claim 1, wherein the formulated grease composition has a dropping point greater than about 260° C. according to ASTM D2265.

24. The process of claim 1, wherein the formulated grease composition has a dropping point greater than about 270° C. according to ASTM D2265.

25. The process of claim 1, wherein the process conditions afford a production throughput of greater than about 6500 lb/hour.

* * * * *